United States Patent [19]

O'Bryan, Jr. et al.

[11] Patent Number: 4,563,661

[45] Date of Patent: Jan. 7, 1986

[54] DIELECTRIC FOR MICROWAVE APPLICATIONS

[75] Inventors: Henry M. O'Bryan, Jr., Plainfield, N.J.; James K. Plourde, Allentown, Pa.; John Thomson, Jr., Wall Township, Monmouth County, N.J.

[73] Assignee: AT&T Bell Laboratories, Murray Hill, N.J.

[21] Appl. No.: 686,240

[22] Filed: Dec. 26, 1984

[51] Int. Cl.[4] ..... H01P 1/30; H01P 7/10

[52] U.S. Cl. ..... 333/202; 333/204; 333/219; 333/235; 423/598

[58] Field of Search ..... 333/219, 202, 204, 205, 333/234–235, 245, 246, 247, 248; 423/598

[56] References Cited

U.S. PATENT DOCUMENTS 3,938,064 2/1976 O'Bryan, Jr. et al. ..... 333/204

4,337,446 6/1982 O'Bryan, Jr. et al. ..... 333/238

*Primary Examiner*—Marvin L. Nussbaum

*Attorney, Agent, or Firm*—Walter G. Nilsen

[57] ABSTRACT

Devices are described which incorporate dielectric material with unusually low (and sometimes negative) temperature coefficient of dielectric constant. Such materials make possible the fabrication of microwave devices which remain stable with changing temperature. This is particularly useful for stabilization of frequency in microwave sources. Stabilization results from the incorporation of small amounts of tin in ceramic material containing mostly $Ba_2Ti_9O_{20}$.

8 Claims, 4 Drawing Figures

DIELECTRIC FOR MICROWAVE APPLICATIONS

TECHNICAL FIELD

The invention involves microwave devices comprising certain ceramic materials.

BACKGROUND OF THE INVENTION

A variety of electrical devices use dielectric materials of various properties for various purposes. For example, materials with moderately high dielectric constants are used in such devices as dielectric resonator filters, microwave stripline circuits, various types of oscillators, as well as phase shifters, to name but a few. Dielectric constant is an important variable in the design of such devices, but equally important are low loss and temperature stability. For one class of devices, low loss is necessary to prevent dissipation of the electrical signal and for the design of circuits with high Q and narrow bandwidth. Temperature stability is required to prevent frequency changes in these devices. Good temperature stability permits much closer control of frequency characteristics when external temperature stabilization is used and may eliminate need for such stabilization in some applications. In addition, external temperature stabilization may not correct for temperature changes due to microwave heating of the dielectric material.

The temperature coefficient of interest here is the one determined by changes of resonant frequency of a dielectric resonator. This effective temperature coefficient includes thermal expansion effects as well as dielectric effects. The effective temperature coefficient is defined by the equation:

$$(TCF) = \frac{1}{f} \frac{df}{dT}$$

in which f is the resonant frequency. It should be noted that $\tau_{eff}$ is also often used to characterize dielectric material in this field. The quantity $\tau_{eff}$ and (TCF) are related by the equation $\tau_{eff} = -2(TCF)$.

The initial widespread use of dielectric material in microwave devices occurred with the discovery that $Ba_2Ti_9O_{20}$ had unusually low temperature coefficients together with high dielectric constants and low microwave losses (high Q). This material is described in a number of references including U.S. Pat. No. 3,938,064, issued to H. M. O'Bryan, Jr. et al on Feb. 10, 1976 and U.S. Pat. No. 4,337,446, issued to H. M. O'Bryan, Jr. et al on June 29, 1982.

The materials disclosed in the references cited above usually had temperature coefficients of resonant frequency (TCF) of about 2-3 ppm/°C. This indeed made it possible to use this material in many applications.

In other applications, still lower (TCF) values were desirable and even negative values of (TCF). This was especially desirable where dielectric heating effects were large or where the device structure made a large contribution to the temperature coefficient. In this latter situation, a negative (TCF) would be desirable to compensate for the contribution to frequency drift due to the device structure.

Also desirable from a fabrication point of view is a procedure for adjusting the (TCF) value for different microwave devices.

SUMMARY OF THE INVENTION

The invention is a microwave device which employs materials of a specific composition as a dielectric material. In approximate terms, the composition is close (within about ±3 percent) to the stoichiometric composition for $Ba_2Ti_9O_{20}$ with up to 10 atom percent (generally 1-10 atom percent) of tin substituted for titanium to decrease the (TCF). In this way the (TCF) can be varied over a significant range, typically from about 2-4 ppm/°C. to less than zero, and generally to about −2 ppm/°C. without adversely affecting the other desirable dielectric properties such as dielectric constant and dielectric loss. Devices incorporating such dielectric material have exceptionally good microwave properties and can be made with exceptionally good temperature compensation.

DETAILED DESCRIPTION

Figure 1:
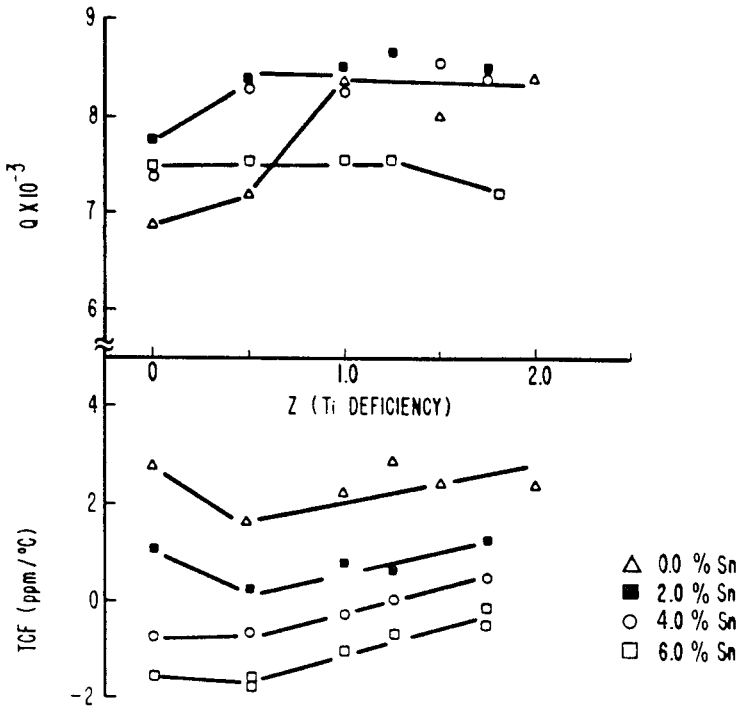
FIG. 1 shows for $Ba_2Ti_9O_{20}$ a graph of Q-factor and (TCF) vs. $TiO_2$ deficiency for no tin incorporation and for various amounts of tin.

The invention is based on the discovery that the substitution of small amounts of tin for titanium in a dielectric ceramic composed largely of $Ba_2Ti_9O_{20}$ significantly lowers the (TCF) (including making the (TCF) negative) without adversely affecting the dielectric properties (e.g., dielectric constant and Q-factor) of the dielectric ceramic. Included in the invention are dielectric materials composed largely of $Ba_2Ti_9O_{20}$ which is deficient in titanium. Such ceramic material is useful in a variety of microwave devices including passband filters, signal source devices, band rejection filter and other devices that process microwave signals. For purposes of this application, signal frequencies from 0.4 to 200 GHz are regarded as microwave signals. Dielectric materials are especially useful for resonator applications over the 0.5-20 GHz frequency range which is above the range where conventional circuit principles apply. The frequency range from 0.5-1.0 GHz is especially important because of the large size of components without ceramic.

The composition of the ceramic dielectric material is critical to obtaining dielectric properties useful in microwave devices. The dielectric material is composed of at least 90 mole percent crystalline material with nominal formula $Ba_2Ti_9O_{20}$ which has been altered either by tin addition (generally replacing titanium) and by titanium deficiency as explained below. The remaining 10 mole percent may be inert material, binder material, etc. In general, best results are obtained when all the dielectric material (at least 99 mole percent) is composed of $Ba_2Ti_9O_{20}$ altered as described above and below.

The desirable properties of the ceramic material are obtained by the addition of tin (believed to replace titanium) and by compositions deficient in titanium. In general, tin substitutions for up to 10 atom percent of the titanium and titanium deficiencies up to 5 atom percent yield useful results.

To better define the desirable compositions, the formula for the crystalline dielectric material is presented with the atom percent of tin substituted (y) and atom percent of titanium deficiency (x) explicitly set forth:

$$Ba_2Ti_{9(1-x-y)}Sn_{9y}O_{20}$$

The atom percent of tin (y) may vary over large limits but the range from 1–10, or preferably 2.0–6.0 seems to yield the best results. The atom percent of titanium deficiency (x) may vary over large limits (e.g., 0–5 percent) but the range from 0–2.0 seems to yield excellent results. Often, the composition depends on the dielectric properties desired and often these properties are best obtained with a combination of tin addition and titanium deficiency. For example, excellent values of (TCF) and Q are obtained with tin additions from y=2-.0–6.0 and titanium deficiencies from x=0.5–2.0.

The invention can be best understood by a presentation of the electrical characteristics of the dielectric material as a function of composition, especially the amount of added tin. The electrical characteristics are measured in the microwave region since this is the primary frequency range of interest for applications and the Q and (TCF) can vary with frequency.

The three properties measured were (TCF), Q-factor and dielectric constant. They are presented in FIGS. 1 and 2. Measurements on (TCF) and Q factor were carried out at 4 GHz while dielectric constant was measured at 1 MHz.

The dielectric constant is obtained by measuring the capacitance of a cylindrical disk of specific geometry. Generally, dielectric constant measurements made at 1 GHz yield the same values as at 4 GHz. The dielectric losses are measured by determining the Q of the $TE_{01}$ dielectric resonator mode and the effective temperature coefficient of the dielectric constant is measured by determining the change in frequency of the dielectric resonator mode as a function of temperature.

FIG. 1 shows for dielectric material with nominal formula $Ba_2Ti_9O_{20}$ the (TCF) and Q-factor as a function of titanium deficiency for various levels of tin substitution. The various tin substitutions shown in the Figure are the values of y defined above. The titanium deficiency (z) is defined slightly differently than the x parameter defined above since it is based on synthesizing the dielectric material from $BaTiO_3$ by the reaction $2BaTiO_3+7TiO_2 \rightarrow Ba_2Ti_9O_{20}$. The z parameter of FIG. 1 is based on the deficiency in $TiO_2$ added (7(1−z/100)) in the above reaction and not (as is the case for the x parameter) on the entire amount of titanium present. The two parameters are related by $$z=9x/7$$

which provides only a small correction.

FIG. 1 shows that the (TCF) parameter may be reduced and made negative with little or no effect on the Q-factor (dielectric losses) of the dielectric material.

Figure 2:
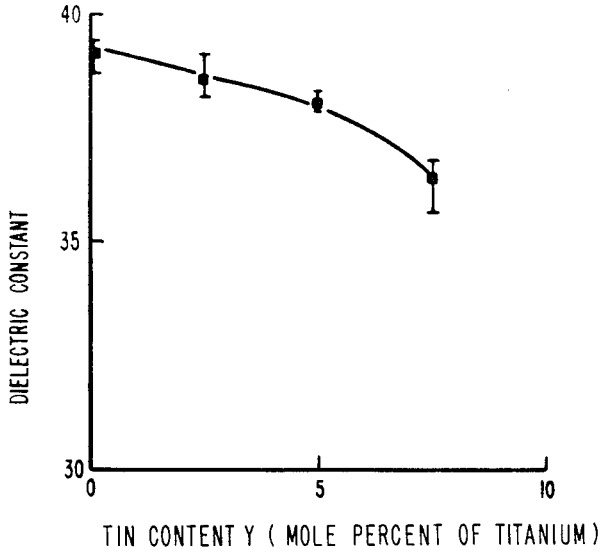
FIG. 2 shows a graph of dielectric constant vs. tin substitution for dielectric material made in accordance with the invention.

FIG. 2 shows the dependence of dielectric constant on tin content. The measurements indicate that titanium deficiency reduces the dielectric constant only slightly. The data in FIG. 2 indicate that tin may be added and titanium made deficient without significant effect on the dielectric constant of the dielectric material.

A large variety of methods can be used for the preparation of the dielectric material. For this reason a polycrystalline technique is advantageous for preparing a ceramic form of the dielectric material.

Exemplary preparation procedures have been described in various places including U.S. Pat. Nos. 3,938,064 and 4,337,446.

A useful preparation procedure involves the use of $BaTiO_3$ together with $TiO_2$ and $SnO_2$ in the preparation procedure. Generally, reagent grade materials are used, since small amounts of impurities are not detrimental to the dielectric properties of the resulting dielectric materials. High purity materials insure good properties but for many commercial applications, reagent grade is satisfactory and less costly.

The appropriate amounts of $BaTiO_3$, $TiO_2$ and $SnO_2$ are used and well-known methods for mixed oxide preparation are used to prepare the dielectric material. This preparation procedure is typically as follows.

Appropriate amounts of $BaTiO_2$, $TiO_2$ and $SnO_2$ are mixed together in a ball mill under water, filtered and dried to remove water and prereacted at 1100°–1150° C. for about six hours in air. After a second ball milling to reduce particle size, the slurry is filtered and dried a second time. At this point, the material is formed into the useful shape and sintered 1300°–1400° C. for at least six hours in oxidizing atmosphere (generally oxygen) for at least about six hours.

Further enhancement in Q (reduction of dielectric loss) is obtained by a further annealing process in essentially pure oxygen atmosphere. This is especially useful for dielectric materials with tin substituted. The annealing procedure involves heating the dielectric material in an oxygen atmosphere at a temperature between 1000° and 1250° C. for sufficient time to maximize the Q-factor (at least six hours but often longer at temperatures below 1250° C.).

A variety of microwave devices may be made using the dielectric material described above. Particularly advantageous is the smaller size of the devices made with this dielectric material. This is most advantageous with microwave frequencies at or less than about 4 GHz. Also advantageous is the fact that dielectric properties can be tailored to the particular application. For example, (TCF) can be adjusted to compensate for the temperature coefficient of other parts of the device so as to yield a temperature-compensated device.

Figure 3:
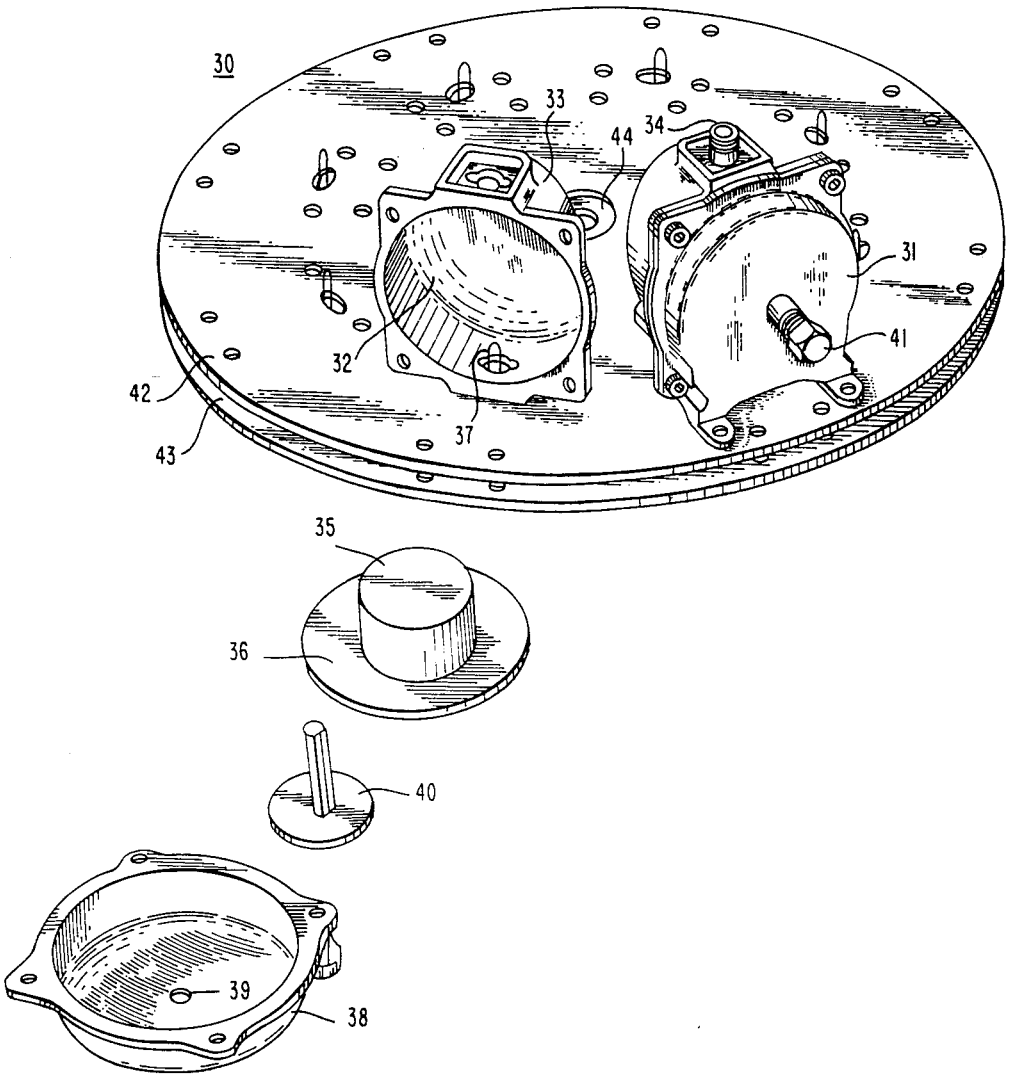
FIG. 3 shows a microwave signal source with a dielectric resonator used to stabilize frequency.

FIG. 3 shows a perspective view of a partly assembled dielectric resonator combiner 30 with several channels operating at different frequencies. Channel frequency control (filter) units 31 are composed of a cylindrical resonator 35 centered in a cylindrical aluminum housing 33. Microwave energy is admitted into the filter through a coax connector and coupling loop (not visible in this drawing). The housing 33 contains a dielectric ceramic resonator 35 (i.e., $Ba_2Ti_9O_{20}$) made in accordance with the invention. The dielectric ceramic is in the form of a right cylinder with resonant frequency near that required by the filter. The dielectric ceramic piece 35 is attached to a round alumina slab 36 and this structure placed in the filter housing so that the ceramic faces inward. Microwave energy is coupled out of the ceramic resonator by means of a coupling loop 37. A cover 38 encloses the filter housing 33 and serves as the mount (through a hole 39 in the cover 38) for the tuning plunger 40 used to trim the resonant frequency of the structure. The tuning screw 41 for the tuning plunger 40 is shown on the assembled channel frequency control unit 31. The units are mounted on a mounting plate 42 which is separated from a base plate 43 so as to provide room for a stripline combining board to combine signals from the various filters. These signals are coupled out of the filters by means of coupling units. The combined signal exits the channel combiner 30 by means of a connector mounted in a hole 44 in the center of the mounting plate 42 and base plate. Judicious choice of the composition of the dielectric resonator material permits temperature compensation for the device so that channel frequency and band characteristics remain constant over operating temperature range.

Figure 4:
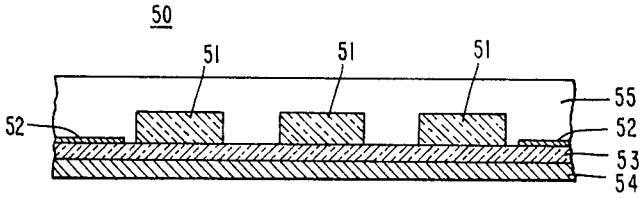
FIG. 4 shows a bandpass filter made in accordance with the invention.

Another class of devices makes use of the dielectric material in a slightly different way. The dielectric resonator has dimensions and shape such that for the frequency of the microwave energy of interest, the microwave energy is resonant (has high energy storage) inside the resonator. A typical device is shown in FIG. 4. This is a bandpass filter 50 which allows a certain band of frequencies to propagate and reject frequencies outside this bandpass. The device shown in FIG. 4 is made up of cylindrical resonators 51 and a stripline conductor 52, ceramic substrate 53 and bottom 54 and top 55 ground planes. Frequency and bandpass characteristics of this device depend largely upon the diameter and height of these cylindrical resonators and spacing between these resonators. In the bandpass filter shown in FIG. 4, the stripline is interrupted in the structure so the structure is non-propagating (in the absence of dielectric resonators) for microwave energy. One or more dielectric resonators are inserted between the interrupted stripline to couple energy from one stripline to another. Direct coupling is achieved by placing the dielectric resonators close together. Coupling can also be multiples of one-quarter wavelength apart when propagating stripline is used between the resonators. The wavelength referred to here is the microwave wavelength inside the microwave filter. Typical dimensions of the dielectric resonator for a center band frequency of 4 GHz is diameter 0.6 inches and height 0.175 inches. Good temperature compensation permits temperature changes for the device without change in the frequency or characteristics of the passband filters.

What is claimed is:

1. An apparatus for processing microwave electrical energy with frequency between 0.4 and 200 GHz comprising dielectric material for interaction with the microwave electrical energy, means for introducing microwave electrical energy into the dielectric material, conducting member to contain the microwave electrical energy in the apparatus in which the dielectric material comprises at least 90 weight percent barium-titanium compound with nominal formula $Ba_2Ti_9O_{20}$ characterized in that the barium-titanium compound has composition $$Ba_2Ti_{9(1-x-y)}Sn_{9y}O_{20}$$

where y varies from 1–10 percent and x varies from 0–5 percent.

2. The apparatus of claim 1 in which y varies from 2.0–6.0 atom percent and x varies from 0–2.0 atom percent.

3. The apparatus of claim 1 in which the frequency is between 0.5 and 20 GHz.

4. The apparatus of claim 3 in which the frequency is between 0.5 and 1.0 GHz.

5. The apparatus of claim 1 in which the dielectric material is synthesized from $BaTiO_3$ by the addition of $TiO_2$.

6. The apparatus of claim 1 in which the dielectric material is in the form of a right cylinder.

7. The apparatus of claim 6 in which the apparatus is a dielectric resonator.

8. The apparatus of claim 1 in which the apparatus is a bandpass filter.

* * * * *